United States Patent [19]

Cox

[11] Patent Number: 5,016,679

[45] Date of Patent: May 21, 1991

[54] ELASTICALLY MOUNTED PNEUMATIC THREAD FEED DEVICE

[75] Inventor: Geradus Cox, Geldrop, Netherlands

[73] Assignee: Sulzer Brothers Limited, Winterthur, Switzerland

[21] Appl. No.: 493,963

[22] Filed: Mar. 13, 1990

[30] Foreign Application Priority Data

Mar. 28, 1989 [CH] Switzerland ..... 1120/89

[51] Int. Cl.[5] ..... D03D 47/34

[52] U.S. Cl. ..... 139/450; 139/194; 139/435.1; 139/435.4; 139/452; 226/97

[58] Field of Search ..... 139/194, 435.1, 450, 139/453, 452, 435.4; 242/147 R, 156.2, 157 R, 157.1 R; 66/125 R, 146; 226/198, 97; 112/302; 28/274

[56] References Cited

U.S. PATENT DOCUMENTS

| | | | |
|---|---|---|---|
| 3,575,217 | 4/1971 | Pfarrwaller | 139/452 |
| 3,834,600 | 9/1974 | Benchemoul | 226/97 |
| 3,945,545 | 3/1976 | Bacro | 226/97 |
| 4,290,461 | 9/1981 | Griffith | 139/452 X |

FOREIGN PATENT DOCUMENTS

| | | |
|---|---|---|
| 0900041 | 1/1985 | Belgium . |
| 0155432 | 9/1985 | European Pat. Off. . |
| 2039547 | 8/1980 | United Kingdom . |

*Primary Examiner*—Andrew M. Falik

*Attorney, Agent, or Firm*—Kenyon & Kenyon

[57] ABSTRACT

A thread feed device comprises at least one thread supply from which thread is taken and supplied to an intermediate store. A first thread feed nozzle is arranged before or after the intermediate store. A resilient thread guide element is arranged after the intermediate store and the first thread feed nozzle, which element the thread enters and leaves at an angle to the thread feed direction of a second thread feed nozzle. The thread feed device reduces stress peaks when the thread is abruptly stopped and is particularly suitable for intermittently feeding threads. Air looms with thread feed devices of this kind have a lower number of weft thread breaks among weft threads with a low braking strength. The spring element, which carries the thread guide element, can be mounted directly on the tube of the first thread nozzle.

24 Claims, 3 Drawing Sheets

ELASTICALLY MOUNTED PNEUMATIC THREAD FEED DEVICE

This invention relates to a thread feed device. More particularly, this invention relates to a thread feed device for a loom.

As is known, various types of devices have been used for the feeding of thread in thread and yarn processing machines, for example in looms. Generally, these thread feed devices ensure that, for example, weft threads of the correct length are delivered to a picking device and can be inserted in a shed within a weaving machine as smoothly and with as few stress peaks as possible, as high stress peaks can be caused by drawing the thread off a thread supply, such as a crosswound bobbin.

A special characteristic of water and air picking systems for looms in particular is that the thread is inserted by indirect as opposed to positive engagement means, i.e. the thread is blown or sprayed into the shed. This means that the thread, which is moving at a high speed of at least approximately 60 meters/second (m/s), has to be suddenly braked and held back on the insertion side, resulting in load and stress peaks. The abrupt braking of the weft thread can lead to breaks and thus production losses, particularly in the case of threads with a low breaking strength and/or looms with fairly large cloth widths. Finally, the maximum economic rotational speed of a loom for a certain article and a certain cloth width may be limited by the maximum permissible picking speed or the maximum permissible retardation when braking the thread. Similar problems always arise when fast-moving threads have to be braked to such a degree that the forces occurring when the threads are retarded reach the thread breaking strength range. Trouble-free operation has until now only been achieved in all these cases by adapting the thread feed speed accordingly.

Accordingly, it is an object of the invention to provide a thread feed device which enables a thread to be stopped such that the forces occurring in the thread are kept to a minimum.

It is another object of the invention to be able to feed a thread into a loom with the lowest possible stress peaks occurring without the braking or retardation time being extended and, thus, without the maximum permissible retardation for a thread being increased.

It is another object of the invention to provide an air operated nozzle for a thread feed device which permits improved picking efficiency.

It is another object of the invention to reduce the number of thread breaks occurring during picking of a thread into a loom via a nozzle.

It is another object of the invention to maximize the picking efficiency of a thread feed device for a loom employing nozzles.

Briefly, the invention provides a thread feed device which includes a store for receiving a supply of thread from a thread supply, a pair of nozzles for conveying the thread with one of the nozzles disposed for picking the thread into a warp shed in a loom and a spring-biased thread guide element for guiding the thread into the downstream nozzle.

The guide element is disposed to deflect the thread in a direction into the downstream nozzle and is movable in a direction towards this nozzle during braking of the thread while being biased in an opposite direction after braking of the thread.

The thread feed device also includes a thread braking and retaining means for intermittently braking and releasing a thread. This braking means may be mounted on the store. In this case, both nozzles are disposed downstream of the braking means.

The thread feed device may also include at least one stop for limiting movement of the guide element in the direction towards the downstream nozzle.

The spring-biased thread guide element enables the thread brake to be abruptly actuated, with the resulting stress peak in the thread being simultaneously reduced to approximately half that occurring in a like thread feed device without a resilient or spring-mounted thread guide element. The resilient or spring-mounted thread guide element which is deflected during the stopping action, springs back into the rest position after braking. The spring properties are in this respect selected according to the respective stopping frequency.

The frequency of breaks among critically loaded threads and yarns, which have until now been loaded to a breaking point during stopping actions, is thus substantially reduced. This offers the possibility of increasing the thread speed.

The thread feed device enables the picking speed and, thus, the maximum picking efficiency to be increased in a jet loom with a water or, in particular, an air picking system with the same or an even reduced number of weft thread breaks when the latter are critically loaded.

The gentler braking action provides the additional advantage—particularly for air looms—that the whip-like recoil of the thread is substantially reduced. The recoil is so slight that the stretching nozzle, which has until now been required on the exit side of the shed, can be eliminated without this resulting in unsatisfactory stretching of the weft thread. In general, the absence of the stretching nozzle enables the excess length of the weft threads to be shortened by approximately 3 centimeters (cm). If the cloth width is 3 meters (m), this corresponds to a saving of the order of 1%. The yarn section on the weft exit side is also shorter by this length which is saved.

Tests have shown that the blowing time of relay nozzles commonly used in an air jet loom could be reduced with the thread feed device while achieving the same picking efficiency. The overall air consumption of a loom of this kind can be reduced by approximately 3.7 grams/second (g/s), which, given a total air consumption of approximately 25 grams/second (g/s) in a machine with a cloth width of 330 centimeters (cm), corresponds to a substantial energy saving of the order of approximately 15% (weft yarn Ne 34.5/1; polyethylene/cotton 50/50).

The spring-biased guide element may also be used in looms with mixing tubes as the main nozzles which have two or more thread channels to cause the weft thread to be automatically pulled back into its mixing tube channel after a cutting operation.

These and other objects and advantages of the invention will become more apparent from the following detailed description taken in conjunction with the accompanying drawings wherein:

FIG. 1 schematically illustrates an air loom having a multiplicity of thread feed devices in accordance with the invention;

Figures 2, 3, 4, 5, 6, 7:
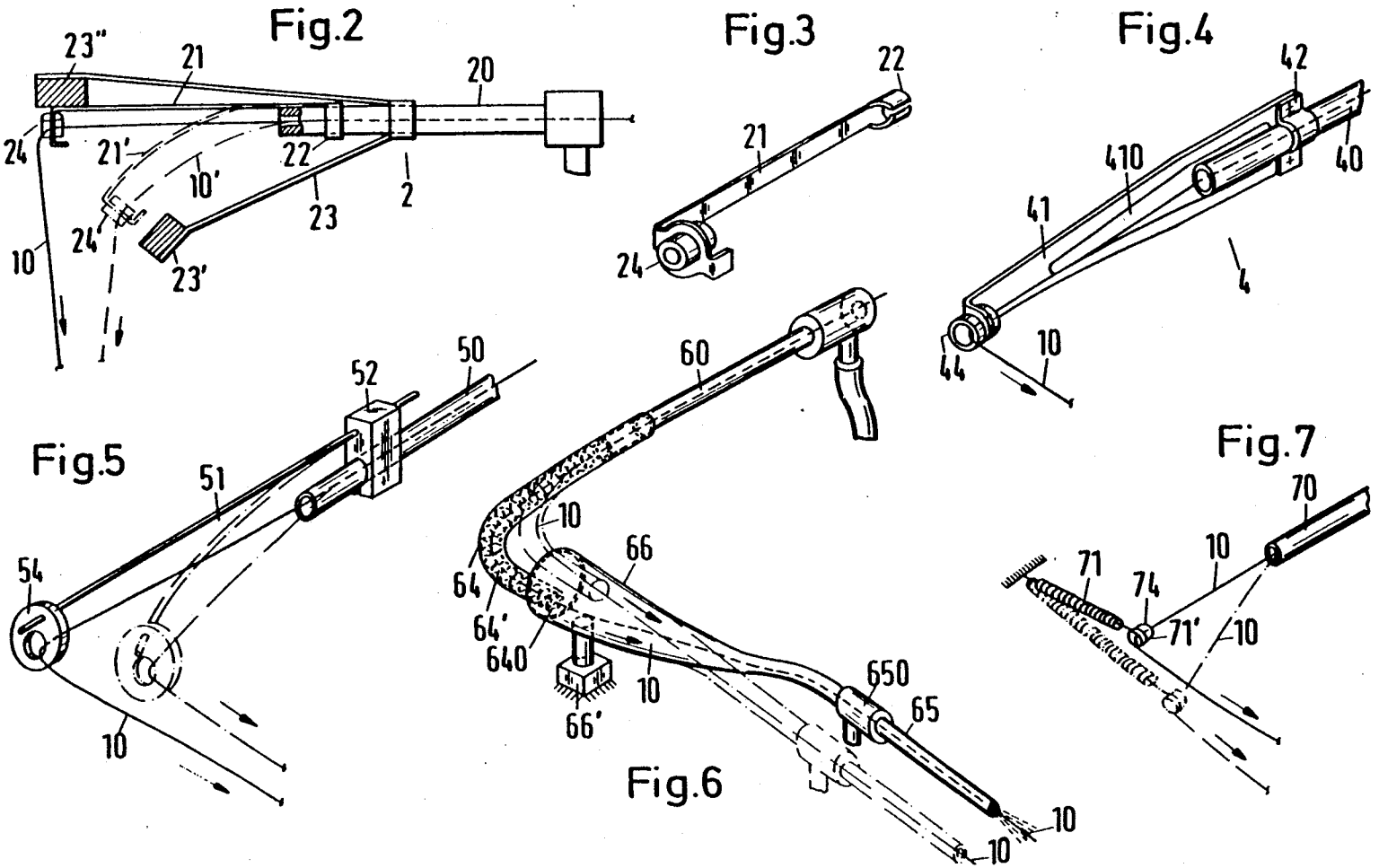
FIG. 2 illustrates a thread feed nozzle having a spring mounted thread guide element thereon in accordance with the invention.
FIG. 3 illustrates a thread guide element mounted on a leaf-like spring element in accordance with the invention.
FIG. 4 illustrates a modified spring element for mounting on a nozzle in accordance with the invention.
FIG. 5 illustrates a further modified thread guide element and spring means in accordance with the invention.
Figure 8:
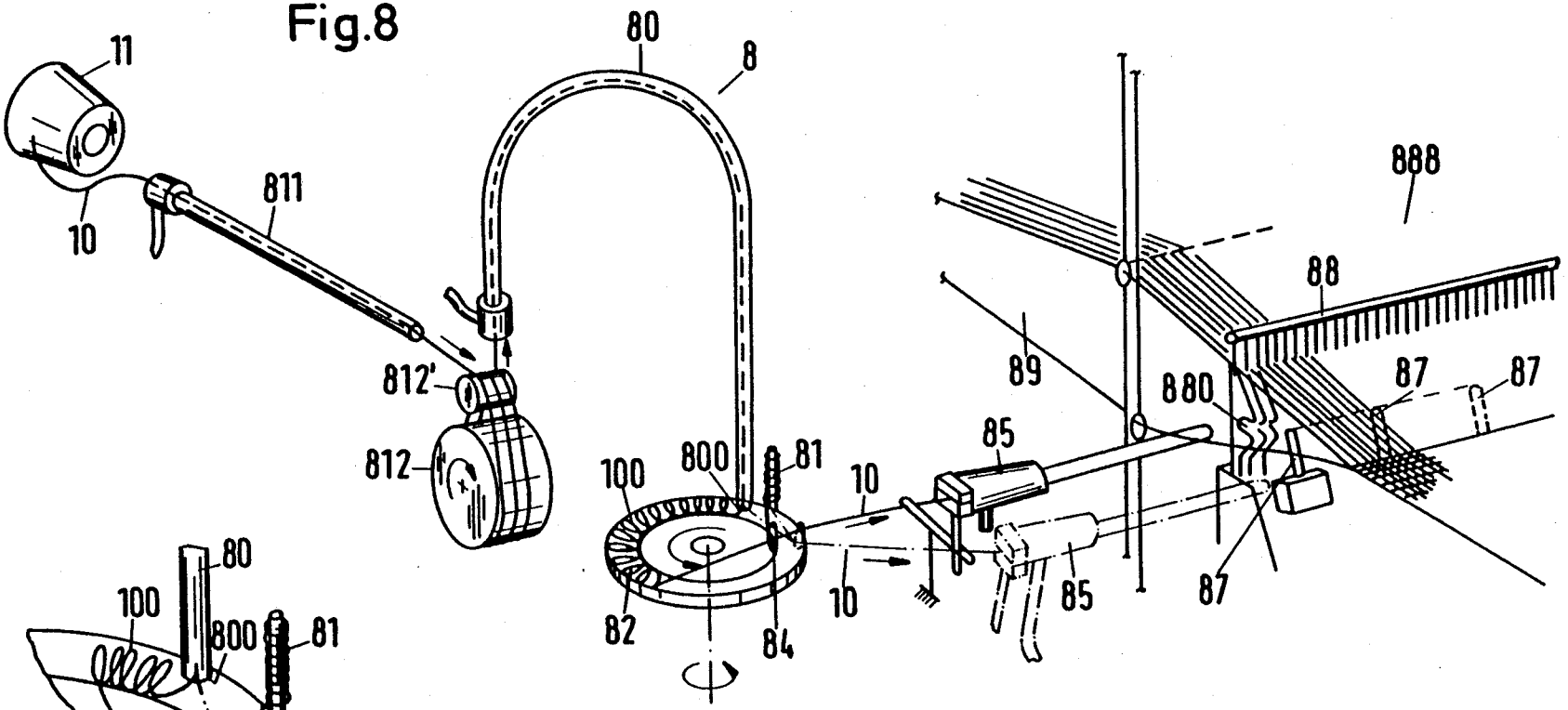
Figure 8A:
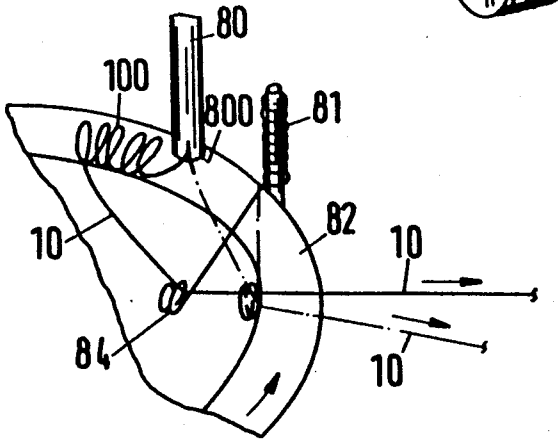

FIG. 6 schematically illustrates a further modified thread guide element in accordance with the invention;

FIG. 7 illustrates a still further modified thread guide element constructed in accordance with the invention;

FIG. 8 illustrates a thread feed device employing a ribbon store in accordance with the invention; and FIG. 8A illustrates a detail of a thread feed device employed in the feed device of FIG. 8.

Figure 1:
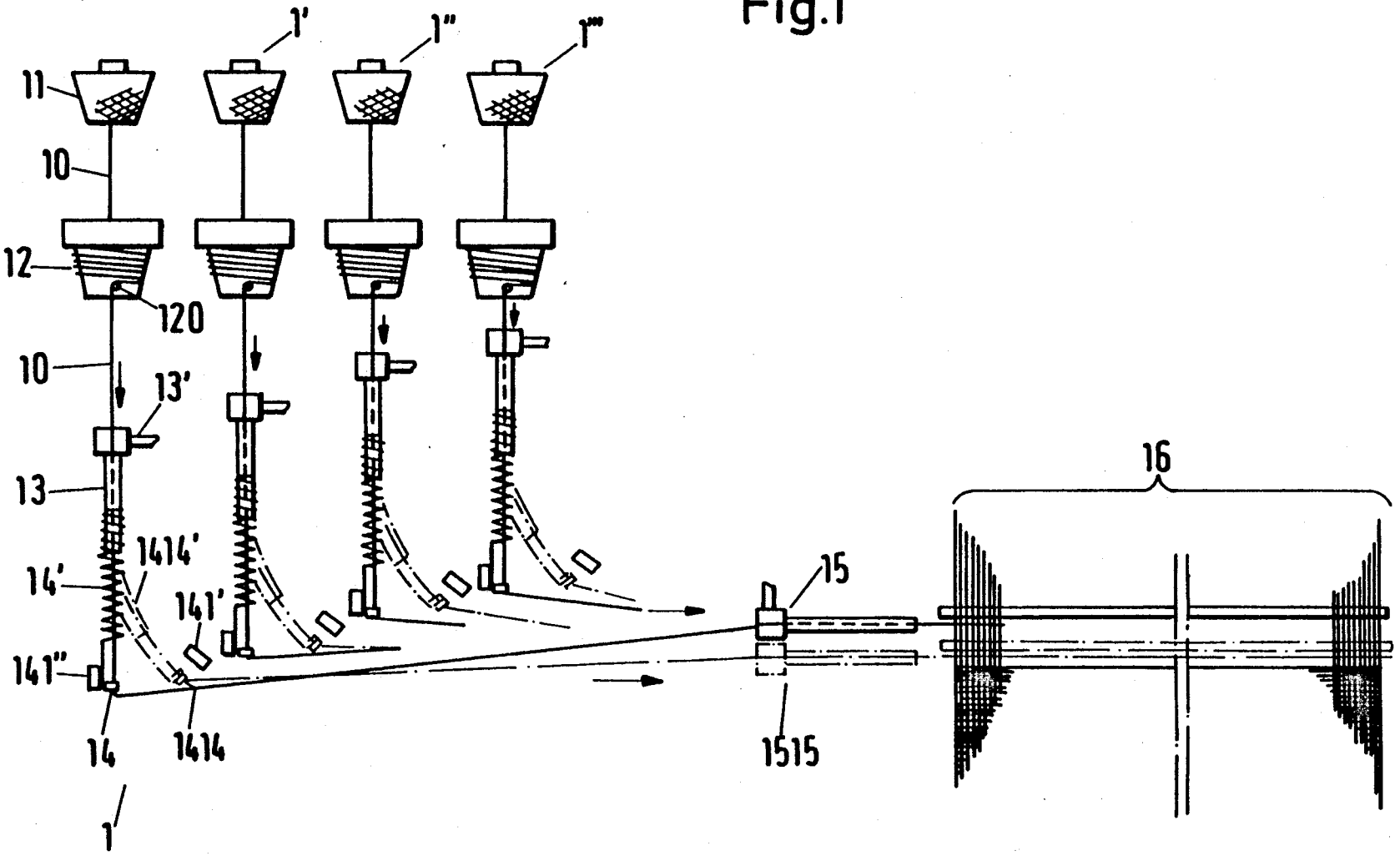

Referring to FIG. 1, a loom 16 is constructed with suitable means (not shown) for forming a plurality of warp threads into a shed. Such constructions are well known and need not be further described. As illustrated, the loom 16 includes a plurality of thread feed devices for the feeding of weft threads into the shed within the loom 16.

Each thread feed device includes a thread supply 11, for example, in the form of a wound bobbin from which a thread 10 is delivered, an intermediate drum store 12 for receiving the thread 10 from the thread supply 11 and one or more thread braking and retaining means 120 on the store 12 for intermittently braking and releasing a thread in time with a picking action.

Each thread feed device also includes a first air nozzle 13 with an air supply connection 13' downstream of the store 12 as well as a second air nozzle 15 which is common to all of the thread feed devices and which functions as the actual main nozzle. As illustrated, each nozzle 13 is disposed in perpendicular relation to the main nozzle 15.

As indicated, the main nozzle 15 is disposed for picking the thread 10 into the warp shed within the loom 16. To this end, the main nozzle 15 is movable from a rest position as indicated in solid line to a displaced condition 1515 indicated by a dotted line in time with the picking of the thread.

Each thread feed device also includes a spring-biased thread guide element in the form of an eye 14 mounted on a spring 14'. This eye 14 is disposed to deflect the thread 10 emanating from the nozzle 13 in a direction towards the main nozzle 15. In addition, the eye 14 is movable in a direction towards the main nozzle 15 during braking of the thread 10 while being biased in the opposite direction after braking to retract the thread 10 relative to the nozzle 15 under the action of the spring 14'.

A pair of stops 141', 141'' are provided for limiting movement of the eye 14 in the direction toward the main nozzle 15 and in the opposite direction.

When the braking means 120 located upstream of the guide element brakes the thread 10, the thread 10 pulls the spring 14' with the eye 14 into the position 1414', 1414, as shown by broken lines, at most, as far as the limit stop 141'. The spring 14' with the eye 14 then swings back into the starting position or, as far as the limit stop 141''. The weft thread 10 is thus pulled back slightly out of the shed of the loom 16 and is simultaneously stretched.

As illustrated in FIG. 1, the guide element 14 serves to deflect the thread 10 over an angle of at least 15°, for example an angle of 90°, towards the main nozzle 15.

The main nozzle 15 may be formed as a weft mixer multiple nozzle, to the channels of which lead the threads of the four thread feed devices 1, 1', 1'' and 1''', for which the main nozzle 15 serves as a common second air thread feed nozzle. In the illustrated example, the main nozzle 15 is mounted on a sley in the loom and moves in time with the latter. In the position 1515, the weft thread 10 is inserted in the shed and is then pulled back slightly, stretched and cut. The end of the weft thread 10 on the insertion side is thus pulled back into the weft mixer channel of the main nozzle 15. The mode of operation of the thread feed device remains essentially the same for a loom with only one thread feed device. The spring-mounted thread guide elements of the thread feed devices 1', 1'' and 1''' also have two respective positions.

Referring to FIGS. 2 and 3, the spring-biased thread guide element may be constructed with a leaf-like spring element 21 which can be placed over a nozzle tube 20 by means of a clamping ring 22 at one end while an eye 24, for example, of ceramic material, hardened metal, hard metal or some other abrasion-resistant material, is mounted at the opposite end. In similar manner, as indicated in FIG. 2, a pair of limit stops 23', 23'' are placed as a unit 23 on the nozzle tube 20 and secured in place.

During use, the thread 10, spring element 21 and eye 24 are deflected into the positions 10', 21', 24', as shown in broken lines in FIG. 2, by the tensile and/or inertia forces of the thread 10.

As indicated in FIG. 2, the combination of the spring element 21, eye 24, stop unit 23 and nozzle 20 form a unit 2 which can be assembled as such in a loom.

Referring to FIG. 4, a unit 4 may be comprised of a leaf spring-like element 41 having a flange 42 which is placed on a tube 40 and which includes an elongated slot 410 for passage of the nozzle 40 during flexing of the spring element 41. In addition, an eye 44 is mounted at the end of the spring element 41. This guide element 44 may be of abrasion-resistant material for the thread 10 and can be pressed or glued into a bore in the spring element 41. Alternatively, the eye 44 can be secured with clamping rings fitted to both sides of the bore 41.

Referring to FIG. 5, the thread guide element may be constructed in the form of a perforated disc 54 while the spring means is in the form of a round spring bar 51 which is mounted on a nozzle 50 by a suitable holder 52. This holder in 52 may be adjustable longitudinally of the nozzle 50. The positions of the thread 10, disc 54 and spring bar 51 when loaded by inertia and tensile forces of the thread 10 are shown by broken lines.

Referring to FIG. 6, the guide element may be in the form of a flexible hose 64 through which the thread 10 may pass longitudinally while the spring means is in the form of a spiral spring 64' of an abrasion-resistant material which is disposed internally of the hose 64. In this case, the hose 64 is slipped over the outlet end of a nozzle tube 60. The opposite end 640 of the tube 64 extends into a flexible funnel 66 which extends between the hose 64 and the main nozzle 65. As illustrated, the funnel 66 is mounted on a holder 66' in fixed manner while the end connects to an inlet 650 of the main nozzle 65 so as to move with the to-and-fro movement of a sley to which the nozzle 65 is connected. The position of a thread 10 in the hose 64 and in the main nozzle 65 is shown in broken lines.

Referring to FIG. 7, wherein like reference characters indicate like parts as above, the guide element may be in the form of an eye 74 mounted within a loop 71' of a helical spring 71 which is fixedly mounted to a suitable support (not shown). As above, when a thread 10 is braked, the eye 74 moves due to the inertia and tensile forces of the thread 10 and is pulled into the position, for example, as shown in dotted line. At the same time, the spring 71 stretches.

Alternatively, it would also be possible to use the loop or bore of a spring instead of a separate eye and, for example, only to reinforce the area of a spring which is subject to friction due to the thread, i.e. to coat or harden the area of the spring so that the spring may be used directly as the deflection element.

Referring to FIG. 8, the thread feed device may be constructed for use with a ribbon store 82. As illustrated, the thread feed device includes a nozzle 811 which receives a thread 10 from a cross-wound bobbin 11 and which delivers the thread via a pair of draw-off rollers 812, 812' to a bent nozzle 80. The nozzle 80, in turn, delivers the thread onto a rotatable disc-like ribbon store 82 which has a coating to retain the thread which is blown onto the store 82. The yarn quantity 100 which is drawn off the bobbin 11 and blown onto the store 82 at a constant speed is adapted exactly to the cloth width and the picking efficiency of the loom 888. A part of the thread length to be inserted is provided on the ribbon store 82 while the other part of the insertion length is fed from the bobbin 11 during the picking action. When the thread supply on the ribbon store 82 is exhausted, the picking speed is abruptly reduced to the speed of the draw-off rollers 812, 812'. The resulting abrupt loading of the thread 10 is now attenuated or moderated by an eye 84 which serves as a thread guide element and which is spring loaded by a spring 81.

As illustrated in FIG. 8, the loom 888 has suitable means for forming a shed 89 while a reed 88 with a weft insertion channel 880, auxiliary or relay nozzles 87 and a main nozzle 85 is moved to-and-fro. As illustrated, the main nozzle 85 moves between the two indicated positions 85, i.e. one shown in solid line and one shown in dotted line.

Referring to FIG. 8A, the ribbon store 82 is positioned at the outlet 800 of the bent nozzle 80 while the eye 84 is in a rest position shown in dotted line. At the moment when the thread is braked or stopped, the eye 84 is moved into the dotted line position under the inertia forces of the weft thread 10.

The invention thus provides a thread feed device which enables a thread to be stopped such that the forces occurring in the thread are kept to a minimum, i.e. the lowest possible stress peaks occur, without the braking time being extended and, thus, without the maximum permissible retardation for a thread being increased.

The invention further provides a thread feed device which permits the picking efficiency of an air operated picking system and loom to be increased.

What is claimed is:

1. A thread feed device comprising an intermediate store for receiving a supply of thread from a thread supply;

a first nozzle for conveying the thread therethrough;

a second nozzle downstream of said first nozzle and said store for picking the thread into a warp shed; and a spring-biased thread guide element for guiding the thread into said second nozzle, said guide element being disposed to deflect the thread in a direction into said second nozzle, said guide element being movable in said direction towards said second nozzle during a braking of a thread at a point upstream of said guide element and being biased in an opposite direction after said braking of the thread to retract the thread relative to said second nozzle.

2. A thread feed device as set forth in claim 1 which further comprises a thread braking and retaining means for intermittently braking and releasing a thread, said first nozzle being disposed downstream of said means and said guide element being disposed downstream of said first nozzle.

3. A thread feed device as set forth in claim 2 wherein said braking and retaining means is mounted on said store.

4. A thread feed device as set forth in claim 1 wherein said guide element is disposed to deflect a thread over an angle of at least 15° towards said second nozzle.

5. A thread feed device as set forth in claim 4 wherein said guide element is disposed to deflect a thread over an angle of 90° towards said second nozzle.

6. A thread feed device as set forth in claim. 1 wherein said guide element is a spring mounted eye.

7. A thread feed device as set forth in claim 1 which further comprises at least one stop for limiting movement of said guide element in said direction towards said second nozzle.

8. A thread feed device as set forth in claim 1 wherein said guide element is mounted on said first nozzle.

9. A thread feed device as set forth in claim 1 wherein each nozzle is an air nozzle.

10. A thread feed device for a loom comprising a store for receiving a thread from a thread supply;

a first nozzle for conveying the thread therethrough;

a second nozzle downstream of said first nozzle for picking of the thread into a warp shed;

a thread guide element disposed to deflect the thread in a direction into said second nozzle;

a thread braking means upstream of said guide element for intermittently braking and releasing a thread passing through said second nozzle; and a spring means mounting said guide element thereon to permit said guide element to move in a direction towards said second nozzle during braking of a thread and biasing said guide element to move, in an opposite direction after braking of the thread.

11. A thread feed device as set forth in claim 10 where in said guide element is an eye.

12. A thread feed device as set forth in claim 11 wherein said spring means is a helical spring secured at one end and having said eye mounted at an opposite end.

13. A thread feed device as set forth in claim 11 wherein said spring means is a leaf-like spring element.

14. A thread feed device as set forth in claim 10 wherein said guide element is a disc and said spring means is a round spring bar.

15. A thread feed device as set forth in claim 10 wherein said guide element is a flexible hose having a thread passing longitudinally therethrough and said spring means is a spiral spring disposed internally of said hose.

16. A thread feed device as set forth in claim 15 which further comprises a flexible funnel extending between said hose and said second nozzle to convey a thread therebetween.

17. A thread feed device as set forth in claim 10 wherein said guide element is integrally disposed at one end of said spring means.

18. A thread feed device as set forth in claim 10 wherein said store is a rotatable disc-like ribbon store disposed between said nozzles and said guide element is positioned in fixed relation relative to said ribbon store.

19. In combination, an elongated feed nozzle for conveying a thread therethrough; and a thread guide element resiliently mounted on an outlet end of said nozzle for guiding a thread therethrough, said guide element being positioned relative to said outlet end of said nozzle to deflect a thread in a first direction and being movable in said direction during a braking of the thread at a point upstream of said guide element and being biased in an opposite direction after said braking of the thread.

20. The combination as set forth in claim 19 wherein said guide element is an eye and which further comprises a leaf-like spring mounting said eye on said nozzle.

21. The combination as set forth in claim 20 wherein said spring includes an elongated slot for passage of said nozzle therethrough during flexing of said spring in said first direction.

22. The combination as set forth in claim 19 wherein said guide element is a disc and which further comprises a round spring bar mounted on said nozzle in longitudinally adjustable manner and secured to said disc.

23. The combination as set forth in claim 19 which further comprises at least one stop mounted on said nozzle for limiting movement of said guide element in said direction.

24. The combination as set forth in claim 19 which further comprises a loom having means to form a shed of warp threads and a second nozzle adjacent said shed for picking a thread into and across said shed, said second nozzle being disposed downstream of said guide element to receive a thread therefrom for picking into said shed.

* * * * *